US012185857B2

(12) United States Patent
Salcedo, Jr. et al.

(10) Patent No.: US 12,185,857 B2
(45) Date of Patent: Jan. 7, 2025

(54) SELF-CONTAINED REMOVABLE AND COLLAPSIBLE APPARATUS FOR THE SECURE DELIVERY AND STORAGE OF PARCELS

(71) Applicants: Ruben Salcedo, Jr., El Paso, TX (US); Sonny Salcedo, El Paso, TX (US)

(72) Inventors: Ruben Salcedo, Jr., El Paso, TX (US); Sonny Salcedo, El Paso, TX (US)

( * ) Notice: Subject to any disclaimer, the term of this patent is extended or adjusted under 35 U.S.C. 154(b) by 51 days.

(21) Appl. No.: 17/746,667

(22) Filed: May 17, 2022

(65) Prior Publication Data

US 2022/0369841 A1 Nov. 24, 2022

Related U.S. Application Data

(60) Provisional application No. 63/189,779, filed on May 18, 2021.

(51) Int. Cl.
*A47G 29/22* (2006.01)
*A47G 29/20* (2006.01)

(52) U.S. Cl.
CPC ..... *A47G 29/22* (2013.01); *A47G 29/20* (2013.01)

(58) Field of Classification Search
CPC ..... A47G 29/20; A47G 29/22; A47G 29/141; B65D 7/26; B65D 9/14; B65D 15/24; B65D 21/086
See application file for complete search history.

(56) References Cited

U.S. PATENT DOCUMENTS 8,740,056 B2 6/2014 Skouboe
9,371,681 B2 1/2016 Tompkins
9,955,812 B2 5/2018 Charbeneau
10,383,471 B1 8/2019 Barnes et al.
10,383,472 B2 8/2019 Hearne
10,779,671 B1 * 9/2020 Hubbard ..... B65D 55/14
11,492,172 B1 * 11/2022 Izquierdo ..... A47G 29/141
(Continued)

FOREIGN PATENT DOCUMENTS

EP 2 086 375 B1 8/2012

OTHER PUBLICATIONS

DoorBox—World's No. 1 Package Delivery Box With Anti-Theft Alarm, www.doorbox.com, downloaded Feb. 26, 2021.
(Continued)

*Primary Examiner* — William L Miller
(74) *Attorney, Agent, or Firm* — Ortiz & Lopez, PLLC; Kermit D. Lopez; Luis M. Ortiz

(57) ABSTRACT

An apparatus for housing a delivered parcel and a method for operating the apparatus. The apparatus can include a self-contained receptacle that is collapsible, removable, and securable to a floor, and can house and secure a parcel within the self-contained receptacle. A lid can be attached to the self-contained receptacle and is slideable with respect to the self-contained receptacle to allow access to the self-contained receptacle for a delivery of the parcel by a courier. The apparatus can include a base or bases secured to the ground that can create a channel within the self-contained receptacle, wherein the channel is lockable with a key that can be positioned into a channel (or channels) when anticipating a delivery of the parcel. The apparatus can prevent the theft of packages/parcels delivered to and left at residences and business.

4 Claims, 7 Drawing Sheets

(56) References Cited

U.S. PATENT DOCUMENTS

| | | | | |
|---|---|---|---|---|
| 11,497,335 | B2 * | 11/2022 | Romanucci | A47G 29/30 |
| 11,672,371 | B1 * | 6/2023 | Paulo | G06Q 10/0836 340/568.1 |
| 2001/0040422 | A1 * | 11/2001 | Gramlich | G07F 17/13 340/532 |
| 2001/0045449 | A1 | 11/2001 | Shannon | |
| 2006/0054620 | A1 * | 3/2006 | Liu | E02B 3/108 220/6 |
| 2014/0008246 | A1 | 1/2014 | Pfeiffer | |
| 2017/0091710 | A1 | 3/2017 | Van Dyke | |
| 2017/0101237 | A1 | 4/2017 | Capous | |
| 2017/0127868 | A1 | 5/2017 | Adewuyi | |
| 2017/0188737 | A1 | 7/2017 | Hippert | |
| 2017/0286905 | A1 * | 10/2017 | Richardson | G06Q 10/0836 |
| 2018/0029760 | A1 | 2/2018 | Maser | |
| 2018/0070753 | A1 * | 3/2018 | Eveloff | H04W 4/025 |
| 2018/0220827 | A1 | 8/2018 | Romanucci | |
| 2018/0303265 | A1 | 10/2018 | Hearne | |
| 2019/0167025 | A1 * | 6/2019 | Cherry | A47G 29/16 |
| 2019/0177089 | A1 | 6/2019 | Benefield | |
| 2020/0024030 | A1 | 1/2020 | Kellerer | |
| 2020/0121087 | A1 * | 4/2020 | Kilburn | A47C 11/00 |
| 2020/0138225 | A1 * | 5/2020 | Martin | B65D 55/02 |
| 2020/0196788 | A1 | 6/2020 | Juhasz | |
| 2020/0281386 | A1 | 9/2020 | Knox | |
| 2020/0327687 | A1 | 10/2020 | Kadowaki et al. | |
| 2020/0352378 | A1 | 11/2020 | Wheaton et al. | |
| 2020/0390260 | A1 * | 12/2020 | Romanucci | A47G 29/30 |
| 2021/0059455 | A1 * | 3/2021 | Bowman | B65D 81/18 |
| 2021/0068542 | A1 | 3/2021 | Blewett et al. | |
| 2021/0148157 | A1 * | 5/2021 | Muniz | G07C 9/00309 |
| 2021/0196071 | A1 * | 7/2021 | Gecho | A47G 29/30 |
| 2022/0248888 | A1 * | 8/2022 | Willhoit | A47L 23/26 |
| 2023/0081315 | A1 * | 3/2023 | Sebro | A47G 29/141 232/38 |

OTHER PUBLICATIONS

"Package theft," Wikipedia, Retrieved from "https://en.wikipedia.org/w/index.php?title=Package_theft&oldid=1019574452", page was last edited on Apr. 24, 2021, at 03:32 (UTC).

"Porch Pirate Chest, An Easy-To-Use, Convenient, Secure Storage Option for Your Courier Deliveries", https://www.preventpackagetheft.com/porch-pirate-chest, downloaded Feb. 26, 2021.

"The Porch Pod," https://www.theporchpod.com/, downloaded Feb. 26, 2021.

* cited by examiner

SELF-CONTAINED REMOVABLE AND COLLAPSIBLE APPARATUS FOR THE SECURE DELIVERY AND STORAGE OF PARCELS

CROSS REFERENCE TO PROVISIONAL APPLICATION

This patent application claims priority under 35 U.S.C. § 119 to U.S. Provisional Patent Application Ser. No. 63/189,779 entitled "Self-Contained Removable and Collapsible Apparatus for the Secure Delivery and Storage of Parcels," which was filed on May 18, 2021, and is incorporated by reference herein in its entirety.

TECHNICAL FIELD

Embodiments relate to devices and systems for preventing the theft of packages/parcels delivered to and left at residences and business. Embodiments also relate to devices that provide security for delivered parcels.

BACKGROUND

Package theft of parcels and other items delivered to residences and commercial locations has become a serious problem with the increasing use of parcel delivery services such as provided by Amazon, Walmart, Target, UPS, the U.S. Postal Service, Uber Eats, Pharmacy Delivery and so on.

Package theft and package thieves (often referred to as 'porch pirates') involves the theft of a package or parcel and can occur anywhere in the distribution channel including theft of packages left at a household. More specifically, 'package theft' can be defined as taking a possession of a package or its contents, outside of a residence or business, where it has been commercially delivered or has been left for commercial pickup, with intent to deprive the rightful owner of the contents. The term "porch piracy" refers to a situation in which an individual steals a package from a porch or other area near the main entrance of a residence before the recipient can retrieve it.

In homes and buildings without doorbells and even in situations where doorbells are available, delivered goods and packages are often left in public areas that are easily accessed by thieves. The lack of an easy method to stop package theft has caused many to turn to neighbors to receive their packages for them. It has also led to increased income for businesses that offer mailbox services, which is an added expense that most people cannot afford. The e-commerce company Amazon began offering delivery to car trunks or delivery lockers, or letting delivery people inside the home of the recipient with an 'Amazon Key'. Amazon also began a program to share theft video from doorbell cameras with police, but this has led to controversy about privacy concerns. Traditional prevention methods such as videos, fences, and obvious signs someone is home, do not appear to have deterred package theft. Prevention methods include concealing packages (e.g., removing branding on boxes, placing packages out of view), removing the target (e.g., delivery to a POD, delivery in late afternoons), and increasing the risk of stealing (e.g., neighborhood watch, package alarms and so on). These efforts to date have not been very successful and are time-consuming and/or result in added expenses to the consumer.

BRIEF SUMMARY

The following summary is provided to facilitate an understanding of some of the innovative features unique to the disclosed embodiments and is not intended to be a full description. A full appreciation of the various aspects of the embodiments disclosed herein can be gained by taking the entire specification, claims, drawings, and abstract as a whole.

It is, therefore, one aspect of the disclosed embodiments to provide for a parcel delivery apparatus for housing and securing a parcel delivered to residence or business and preventing the theft of the parcel.

It is another aspect of the disclosed embodiments to provide for a parcel delivery apparatus that can function as a self-contained receptacle that is collapsible, removable, and securable to the ground or a floor at a residence or a business with a base or group of bases.

The aforementioned aspects and other objectives and advantages can now be achieved as described herein. In an embodiment, an apparatus for housing a delivered parcel, can include a self-contained receptacle comprising at least one base, wherein the self-contained receptacle is collapsible, removable, and securable to a floor, and houses and secures a parcel within the self-contained receptacle; a lid attached to the self-contained receptacle, wherein the lid is slideable with respect to the self-contained receptacle to allow access to the self-contained receptacle for a delivery of the parcel by a courier; and a locking mechanism comprising a combination lock and a mounting, wherein the locking mechanism secures the lid to the self-contained receptacle with the combination lock and the mounting, wherein the combination code is provided to the courier in advance of the delivery of the parcel to allow the courier to unlock and slide the lid into an open position and place the parcel within the self-contained receptacle and thereafter slide and lock the lid into a closed position to the secure package within the self-contained receptacle.

In an embodiment, the base can create a channel within the self-contained receptacle, wherein the channel is lockable with a key that can be positioned into the channel when anticipating a delivery of the parcel.

In an embodiment, a box that forms that self-contained receptacle can include a corresponding channel matching the base that can be configured into the box with respect to a matching slit.

In an embodiment, the apparatus for housing a delivered parcel can function as a self-contained removable/collapsible receptacle that can provide security for delivered parcels by using one or more "bases" secured to the ground by an adhesive at or around a residence or a business' welcome mat or at a designated delivery area.

In an embodiment, the removable/collapsible receptacle can attach to the ground or a floor and can be secure (locked) into place by connecting to the aforementioned "base".

In an embodiment, a lid can slide open to provide access for deliveries and can be locked on the outside of self-contained removable/collapsible receptacle by a combination lock and a mounting.

In an embodiment, the self-contained removable/collapsible receptacle can be opened by a delivery person or courier using, for example, a combination code that can be provided by the customer.

In an embodiment, the aforementioned delivery person or courier can slide open the lid of the self-contained removable/collapsible receptacle and place the delivered parcel/product inside, and can then slide the lid into a closed position and lock the self-contained removable/collapsible receptacle.

In an embodiment, an owner can arrive home and unlock the self-contained removable/collapsible receptacle by unlocking the combination lock, sliding the lid open to retrieve the parcel/product. The owner can then "disengage" the locking mechanism at the base of the box and is now able to remove entire box (i.e., the self-contained removable/collapsible receptacle can be then used for storage or dissembled and reassembled later).

In an embodiment, the aforementioned 'base' (or bases) can be secured to the ground by an adhesive and positioned in such a manner to align with the self-contained removable/collapsible receptacle. This alignment by the base and self-contained removable/collapsible receptacle is what creates the configuration that can be utilized to create the "lock".

In an embodiment, the 'bases' can be configured to create a channel (or channels) within the self-contained removable/collapsible receptacle, which can be then locked by a key that can be positioned into the channel(s) when expecting a parcel delivery.

In an embodiment, the self-contained removable/collapsible receptacle can be secured to the ground and the "lock" or locking mechanism can only be removable by gaining access to the inside of the self-contained removable/collapsible receptacle.

In an embodiment, the self-contained removable/collapsible receptacle can include a locking mechanism plate that can be secured to a variety of surfaces for the purpose of creating a secured delivery depot.

In an embodiment, the securing mechanism utilized for the self-contained removable/collapsible receptacle can be designed to be inconspicuous (e.g., not drawing attention the securing mechanism by means of size and hiding in plain sight).

In an embodiment, all that may be needed to conceal the securing mechanism associated with the self-contained removable/collapsible receptacle is, for example, a welcome mat or a covering.

In an embodiment, the locking device of the self-contained removable/collapsible receptacle can be configured with a base plate that can be secured to the ground with an adhesive on a bottom side thereof.

In an embodiment, a top side can be formed with a unique configuration that can be designed with a purpose of creating a channel within the self-contained removable/collapsible receptacle that cab serve as a track for the lid to slide open and close.

In an embodiment a key or 'key mechanism' can be utilized to secure the self-contained removable/collapsible receptacle to the ground.

In an embodiment, the aforementioned key can easily slide into place when the self-contained removable/collapsible receptacle is engaged for a delivery and can be attached to the box (i.e., the self-contained removable/collapsible receptacle) and or a slit can be provided inside of the self-contained removable/collapsible receptacle for storage of the key.

In an embodiment, the self-contained removable/collapsible receptacle can be designed to be self-contained. The only way to disable the locking mechanism is to have access to the inside of the self-contained removable/collapsible receptacle. The only way to deconstruct the self-contained removable/collapsible receptacle is to have access to the self-contained removable/collapsible receptacle without a lid.

In an embodiment, self-contained removable/collapsible receptacle (i.e., 'the box') can be multi-purposed. In some cases, the self-contained removable/collapsible receptacle can appear and function as a faux flower planter box, for example, when not in use. When not in use the box can be inverted and used as a tote for storage or in a manner the owner sees fit. The self-contained removable/collapsible receptacle preferably includes four panels and a lid. Two long sides and two short sides can create the general shape of the box that forms the self-contained removable/collapsible. The four panels can include groove channels that correspond and slide into place to create the receptacle. These panels can be connected at the joints of the self-contained removable/collapsible receptacle. The lid can function as a structural support for the self-contained removable/collapsible receptacle by sliding into the self-contained removable/collapsible receptacle rather than on top. The lid can function as the top of the self-contained removable/collapsible receptacle when a delivery is expected and the box is engaged and can function as the bottom of the box when the self-contained removable/collapsible receptacle is used as a general tote. The box can also be collapsible and can disassemble for easier storage.

In an embodiment, the corners of the box can be designed in a manner that can provide a greater surface area for the key to secure the box to the locking mechanism.

In an embodiment, this greater surface area may be used as finger grips for tote when the self-contained removable/collapsible receptacle is not in use.

In an embodiment, the lid can be removable from the four walls and can slide in to create the "lid". The lid can contain a locking mount that can secure the lid to the self-contained removable/collapsible receptacle when a combination lock is in place.

BRIEF DESCRIPTION OF THE DRAWINGS

The accompanying figures, in which like reference numerals refer to identical or functionally-similar elements throughout the separate views and which are incorporated in and form a part of the specification, further illustrate the present invention and, together with the detailed description of the invention, serve to explain the principles of the embodiments.

DETAILED DESCRIPTION

Figure 1:
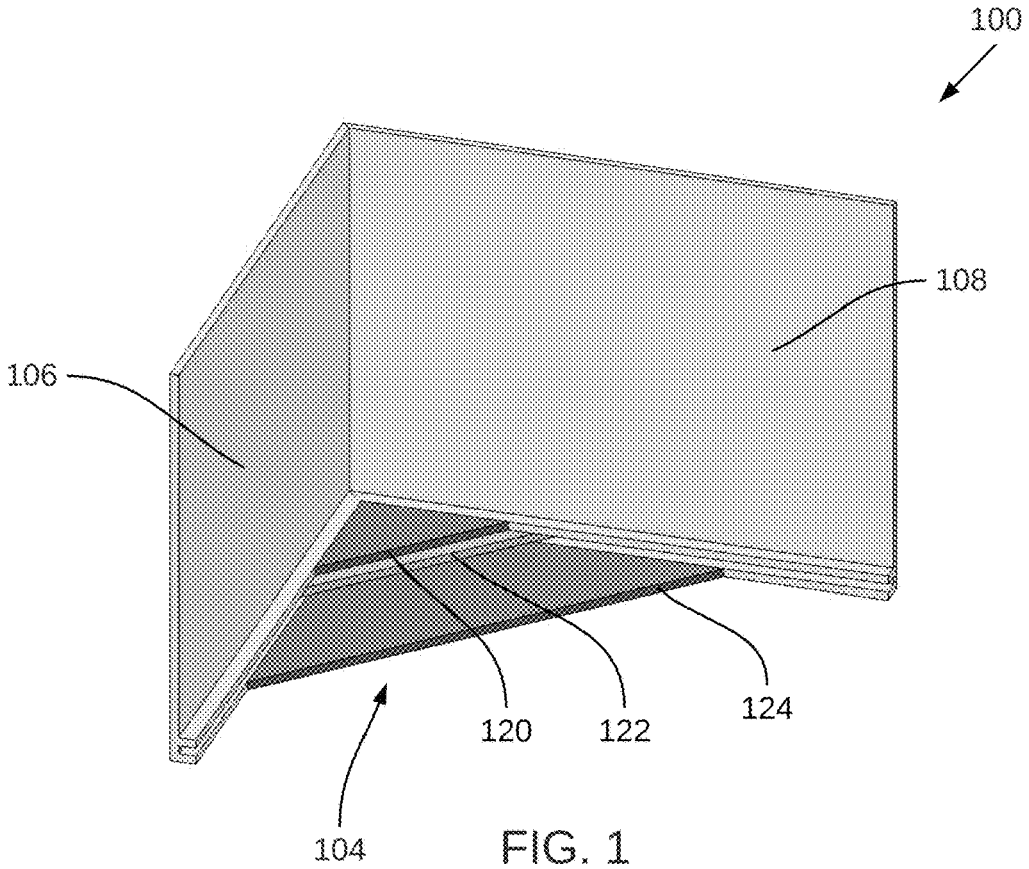
FIG. 1 illustrates a pictorial diagram of an apparatus for housing a delivered parcel, in accordance with an embodiment.

The particular values and configurations discussed in these non-limiting examples can be varied and are cited merely to illustrate one or more embodiments and are not intended to limit the scope thereof. Exemplary embodiments are intended to cover all alternatives, modifications, and equivalents as may be included within the spirit and scope of the composition, apparatus and systems as described herein.

A more complete understanding of the apparatus disclosed herein can be obtained by reference to the accompanying drawings. These figures are merely schematic representations based on convenience and the ease of demonstrating the existing art and/or the present development, and are, therefore, not intended to indicate relative size and dimensions of the assemblies or components thereof. In the drawings, like reference numerals may be used throughout to designate similar or identical elements.

Subject matter will now be described more fully hereinafter with reference to the accompanying drawings, which form a part hereof, and which show, by way of illustration, specific example embodiments. Subject matter may, however, be embodied in a variety of different forms and, therefore, covered or claimed subject matter is intended to be construed as not being limited to any example embodiments set forth herein; example embodiments are provided merely to be illustrative. Likewise, a reasonably broad scope for claimed or covered subject matter is intended. Among other things, for example, subject matter may be embodied as an apparatus, methods, processes, components, or systems. The following detailed description is, therefore, not intended to be interpreted in a limiting sense.

Throughout the specification and claims, terms may have nuanced meanings suggested or implied in context beyond an explicitly stated meaning. Likewise, phrases such as "in one embodiment" or "in an embodiment" or "in an example embodiment" and variations thereof as utilized herein may or may not necessarily refer to the same embodiment. Similarly, the phrase "in another embodiment" or "in another example embodiment" or "in alternative embodiment" and variations thereof as utilized herein may or may not necessarily refer to a different embodiment. It is intended, for example, that claimed subject matter include combinations of example embodiments in whole or in part.

In general, terminology may be understood, at least in part, from usage in context. For example, terms such as "and," "or," or "and/or" as used herein may include a variety of meanings that may depend, at least in part, upon the context in which such terms are used. Typically, "or" if used to associate a list, such as A, B, or C, is intended to mean A, B, and C, here used in the inclusive sense, as well as A, B, or C, here used in the exclusive sense. In addition, the term "one or more" as used herein, depending at least in part upon context, may be used to describe any feature, structure, or characteristic in a singular sense or may be used to describe combinations of features, structures, or characteristics in a plural sense. Similarly, terms such as "a," "an," or "the", again, may be understood to convey a singular usage or to convey a plural usage, depending at least in part upon context. In addition, the term "based on" may be understood as not necessarily intended to convey an exclusive set of factors and may, instead, allow for existence of additional factors not necessarily expressly described, again, depending at least in part on context.

Although specific terms are used in the following description for the sake of clarity, these terms are intended to refer only to the particular structure of the embodiments selected for illustration in the drawings, and are not intended to define or limit the scope of the disclosure. In the drawings and the following description below, it is to be understood that like numeric designations refer to components of like function.

The modifier "about" used in connection with a quantity may be inclusive of the stated value and can have a meaning dictated by the context (for example, it may include at least the degree of error associated with the measurement of the particular quantity). When used with a specific value, it should also be considered as disclosing that value. For example, the term "about 2" also discloses the value "2" and the range "from about 2 to about 4" also discloses the range "from 2 to 4."

Although embodiments are not limited in this regard, the terms "plurality" and "a plurality" as used herein may include, for example, "multiple" or "two or more". The terms "plurality" or "a plurality" may be used throughout the specification to describe two or more components, devices, elements, units, parameters, or the like. For example, "a plurality of widgets" may include two or more widgets. The terms "first," "second," and the like, herein may not denote any order, quantity, or importance, but rather can be used to distinguish one element from another. The terms "a" and "an" herein may not denote a limitation of quantity, but rather can denote the presence of at least one of the referenced item.

FIG. 1 illustrates a pictorial diagram of an apparatus 100 for housing a delivered parcel, in accordance with an embodiment. The apparatus 100 can function as a self-contained receptacle that includes one or more walls such as a wall 106, a wall 108, and so on. In this regard, the 'apparatus' may also be referred to as a self-contained removable/collapsible receptacle.

Figure 7:
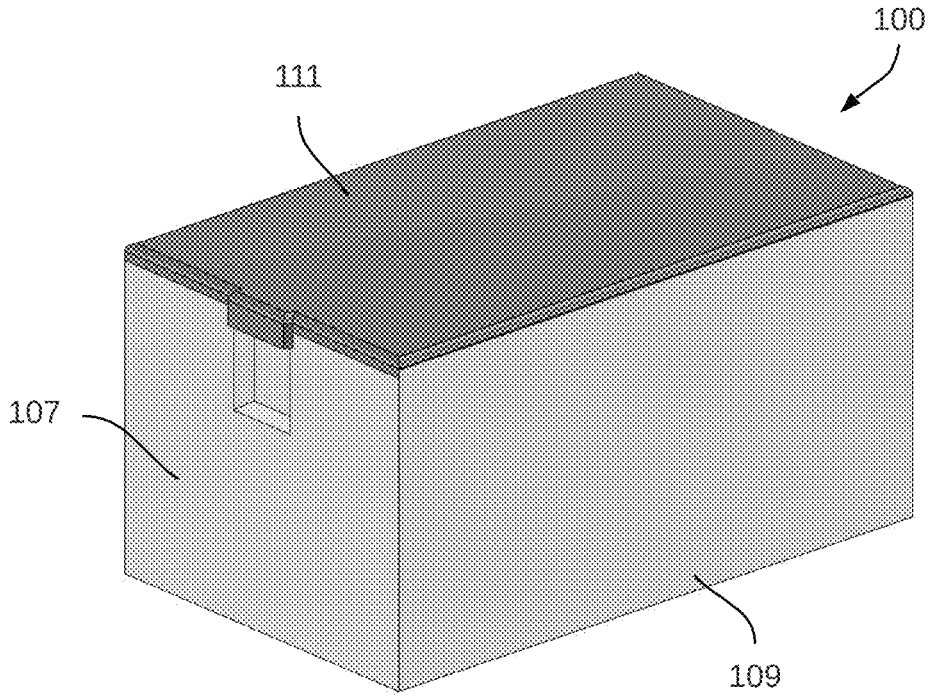
FIG. 7 illustrates a perspective view of an apparatus for housing a delivered parcel, with a lid shown in place, in accordance with an embodiment.

In a preferred embodiment, the apparatus 100 is generally shaped in the form of a box having four walls including the wall 106, the wall 108 and two other walls (not shown in FIG. 1 but depicted in FIG. 7 as wall 107 and 109). The aforementioned walls form the self-contained receptacle. It can be appreciated that the apparatus 100 may be implemented with a plurality of walls, the number of which may include four walls, five walls, six walls, and so on. A preferred embodiment will likely include four walls. However, other embodiments can include more than four walls (e.g., an octagonal shaped self-contained receptacle or other configuration).

The apparatus 100 (i.e., the self-contained receptacle) includes one or more bases such as a base 102, which can be secured to the ground and located at, for example, a corner of the apparatus 100 or another appropriate location associated with the apparatus 100. The apparatus 100 is operable as a collapsible and removable device that can be and secured to a floor utilizing a base (or group of bases) as discussed herein. The apparatus 100 can house and secure a parcel within the self-contained receptacle.

A lid (not shown in FIG. 1 but shown as lid 111 in FIG. 11) can be attached to the self-contained receptacle. Such lid can be slideable with respect to the self-contained receptacle to allow access to the self-contained receptacle for a delivery of a parcel by a courier.

In some embodiments, a combination lock (not shown in FIG. 1) and a mounting (not shown in FIG. 1) may be used with the apparatus 100. The locking mechanism 104 shown in FIG. 1 is generally triangular in shape and can include three layers or plates 120, 122, 124, which are also each generally triangular in shape. It should be appreciated that the locking mechanism 104 shown in FIG. 1 and FIG. 2 relates to the overall locking device used for securing the apparatus 100 to the ground. The plate 124 can function as a bottom adhesive plate and the plate 120 can function as a locking top base plate 120. The plate 122 is located between the plate 120 and the plate 124.

Note that the term 'base' as utilized herein can refer to an individual plate such as plates 120, 122 and/or 124. The term 'bases' utilized herein can refer to a group of plates such as plates 120, 122, and/or 124. Thus, the term 'base' may refer to a group of plates or bases as plates 120, 122, and/or 124, or can refer to an individual plate such as plate 120, 122, or 124.

The locking mechanism 104 can secure a lid (not shown in FIG. 1) to the self-contained receptacle with the combination lock and the mounting. In some embodiments, a combination code can be provided to a courier in advance of the delivery of the parcel to allow the courier to unlock and slide the lid into an open position and place the parcel within the self-contained receptacle and thereafter slide and lock the lid into a closed position to secure package within the self-contained receptacle.

Figure 2:
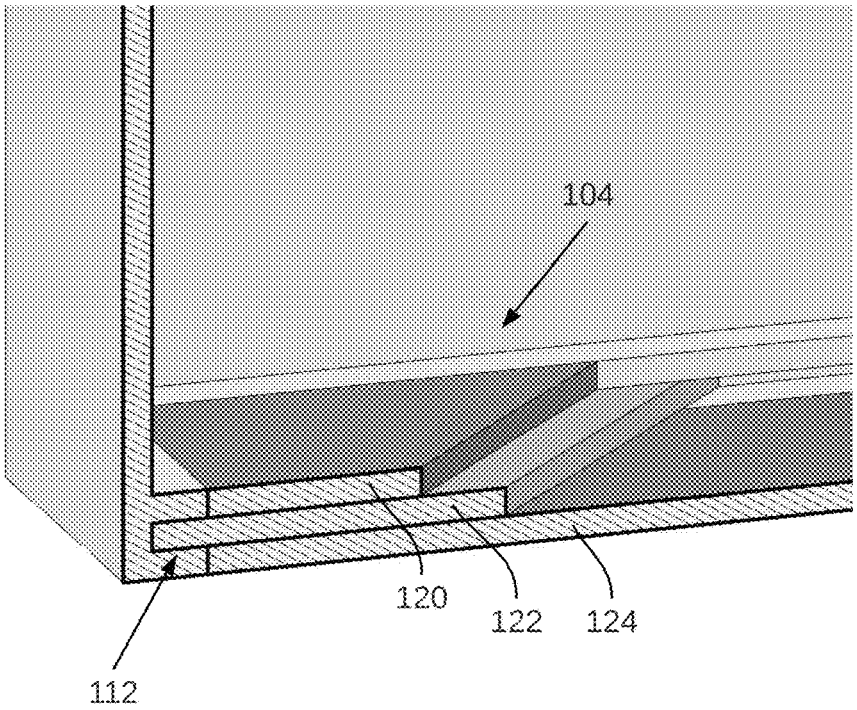
FIG. 2 illustrates a cut-away view of the apparatus for housing a delivered parcel depicted in FIG. 1, in accordance with an embodiment.

FIG. 2 illustrates a cut-away view of the apparatus 100 depicted in FIG. 1, in accordance with an embodiment. Note that as utilized with the figures herein, identical reference numerals generally refer to identical or similar parts or elements. FIG. 2 thus depicts a more detailed and alternative view of the apparatus 100 shown in FIG. 1, and in particular, the locking mechanism 104. As shown in FIG. 2, the locking mechanism 104 can include the use of one or more base plates including the bottom adhesive plate 124 and the locking top base plate 120. Interlocking channels such as channels 112 may be cut into the box, which can engage with one another.

Thus, the apparatus 100 can function as a self-contained removable/collapsible device that can provide security for delivered parcels and can include one or more "bases" secured to the ground by an adhesive at a residence, a business' welcome mat, or an appropriate designated delivery area. The removable/collapsible receptacle attaches and secures (locks) into place. The previously mentioned lid can slide open to provide access for parcel deliveries and can be locked on the outside of receptacle by a combination lock and mounting.

Figure 3:
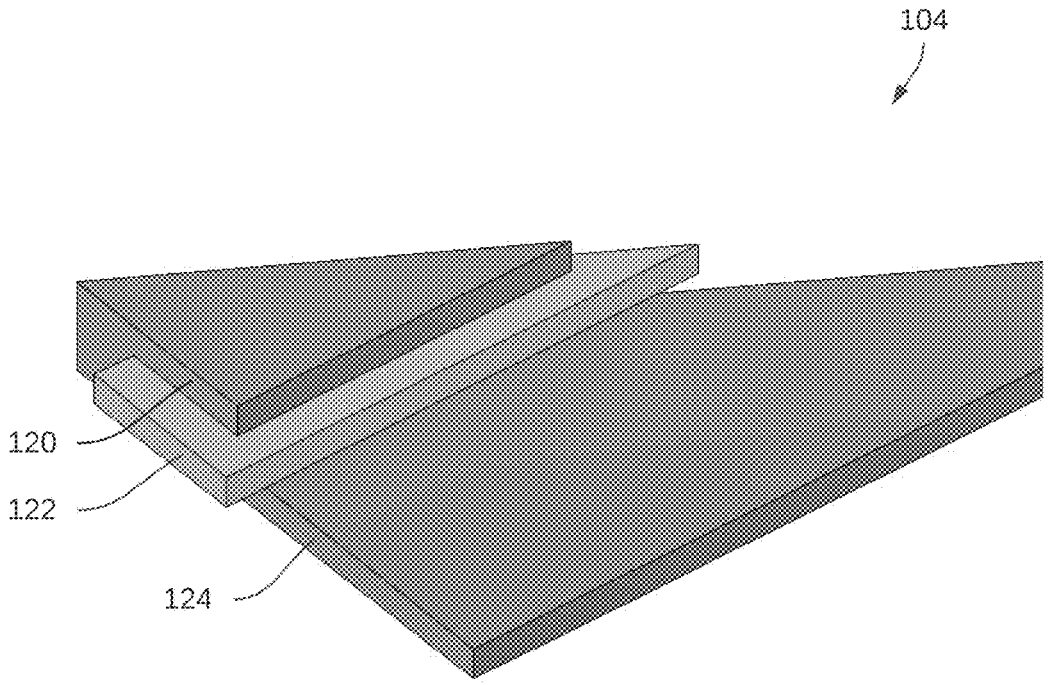
FIG. 3 illustrates a cut-away view of a secured base plate with a key engaged, in accordance with an embodiment.

FIG. 3 illustrates a cut-away view of the locking mechanism 104 including the secured base plate with a key engaged, in accordance with an embodiment. That is, the locking mechanism 104 includes the aforementioned one or more plates 120, 122, and 124. The plate 122 is shown in FIG. 3 as locked in place between the plates 120 and 124. The "bases" composed of the base plates 120, 122 and 124 can be secured to the ground by an adhesive and positioned in such a manner to align with the apparatus 100.

The channel(s) 112 can be "locked" by a key (e.g., plate 122) that can be positioned into the channel(s) 112 when anticipating or expecting a parcel delivery, thereby securing the apparatus 100 to the ground. The "lock" may only be removable by gaining access to the inside of the receptacle. The locking mechanism base(s) configured from the plates 120, 122 and/or 124 can be secured to a variety of surfaces for the purpose of creating a secure delivery depot. The plate 122 can comprise the aforementioned key.

Figure 4:
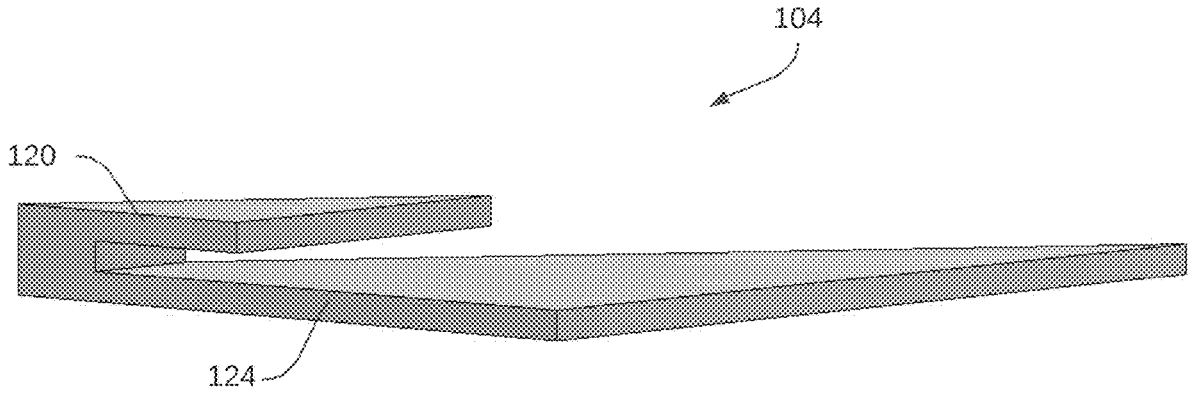
FIG. 4 illustrates a cut-away view of a secured base plate, in accordance with an embodiment.

FIG. 4 illustrates a cut-away view of a secured base plate of the locking mechanism 104, in accordance with an embodiment. As shown in FIG. 4, the secured base plate includes the plates 120 and 124. As shown in FIG. 4, the plates 120 and 124 connected to one another and form a gap between the plates 120 and 124. The plate 122 can be inserted into the gap formed between the plates 120 and 124.

Figure 5:
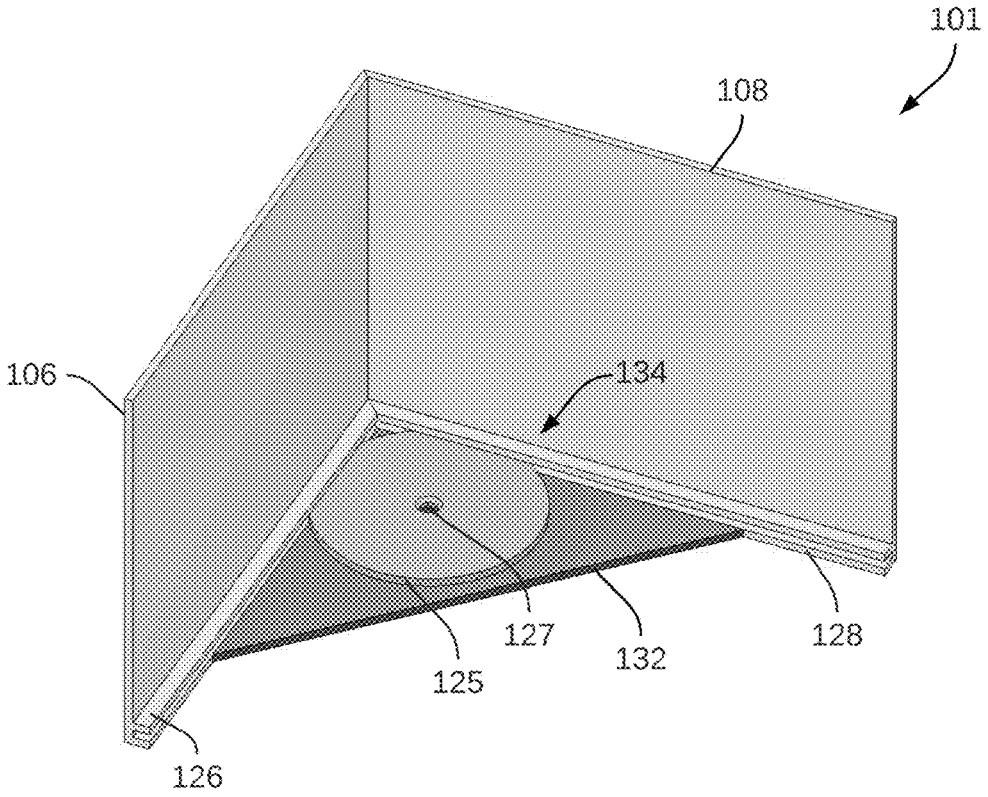
FIG. 5 illustrates a perspective view of an apparatus for housing a delivered parcel, in accordance with an embodiment.

FIG. 5 illustrates cut-away view of an apparatus 101 for housing a delivered parcel, in accordance with an alternative embodiment. Note that the apparatus 101 is similar to the previously discussed apparatus 100, but includes some differences, such as the use of a circular plate 125 having a center 127 as part of a locking mechanism 134. The plate 125 defines a key. The apparatus 101 also functions as a self-contained receptacle. The circular plate 125 sits above a plate 132 and is inserted into a side rail 126 and a side rail 128 defining a channel. The side rail 126 and the side rail 128 can respectively connect to the wall 106 and the wall 108.

Figure 6:
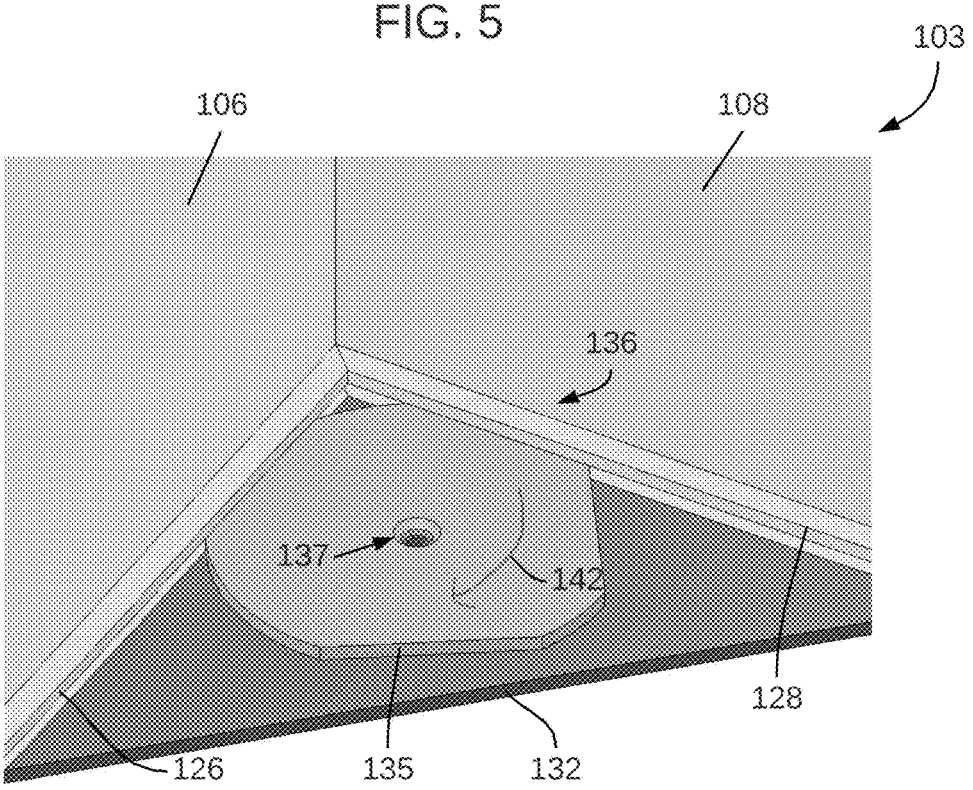
FIG. 6 illustrates a cut-away view of an apparatus for housing a delivered parcel, in accordance with an embodiment.

FIG. 6 illustrates a cut-away view of an apparatus 103 for housing a delivered parcel, in accordance with an alternative embodiment. In the alternative embodiment depicted in FIG. 6, a locking mechanism 136 can be implemented, which includes a partially circular plate 135 and a base plate 132 upon which the circular plate is located. The plate 135 defines a key. The partially circular plate 135 can rotate in the direction indicated by arrow 142 about a center 137 to engage with and insert into the rails 126 and 128. The apparatus 103 is also an example of a self-contained receptacle.

It should be appreciated that the various securing mechanisms discussed herein, such as the locking mechanism 104, the locking mechanism 134, and the locking mechanism 136 can be designed to be inconspicuous. That is, they are configured not to drawn attention to the securing mechanism by means of their size and hiding in plain sight. All that is needed to conceal the securing mechanisms is, for example, a welcome mat or a covering.

The locking mechanisms 104, 134, and 136 can be configured from a base plate that can be secured to the ground with an adhesive on the bottom side. The apparatus 100, the apparatus 101 or the apparatus 103 can be configured with corresponding channels near the bases that allow the "lock" to function. The top of the apparatus 100 can be configured with a unique configuration that can be designed with a purpose of creating a channel within the removable/collapsible receptacle to allow the lid to slide open/close. A "key" can be utilized to secure the apparatus 100, 101, or 103 to the ground.

The key can easily slide into place when the receptacle is engaged for a delivery and can be attached to the box and/or or a slit may be provided inside of the self-contained receptacle for storage of the key and/or the slit.

The self-contained receptacle (e.g., such as the apparatus 100, the apparatus 101, and the apparatus 103) can be designed to be self-contained. The only way to disable the locking mechanism is to have access to the inside of the receptacle. The only way to deconstruct the self-contained receptacle is to have access to the receptacle without a lid (such as the lid 111 shown in FIG. 11).

FIG. 7 illustrates a perspective view of the apparatus 100 for housing a delivered parcel, with a lid 111 shown in place, in accordance with an embodiment. Note that the embodiment shown in FIG. 7 also depicts a wall 107 and a wall 109. It can be appreciated that the apparatus 100 can include four walls including the previously discussed wall 106 and wall 108.

Figure 8:
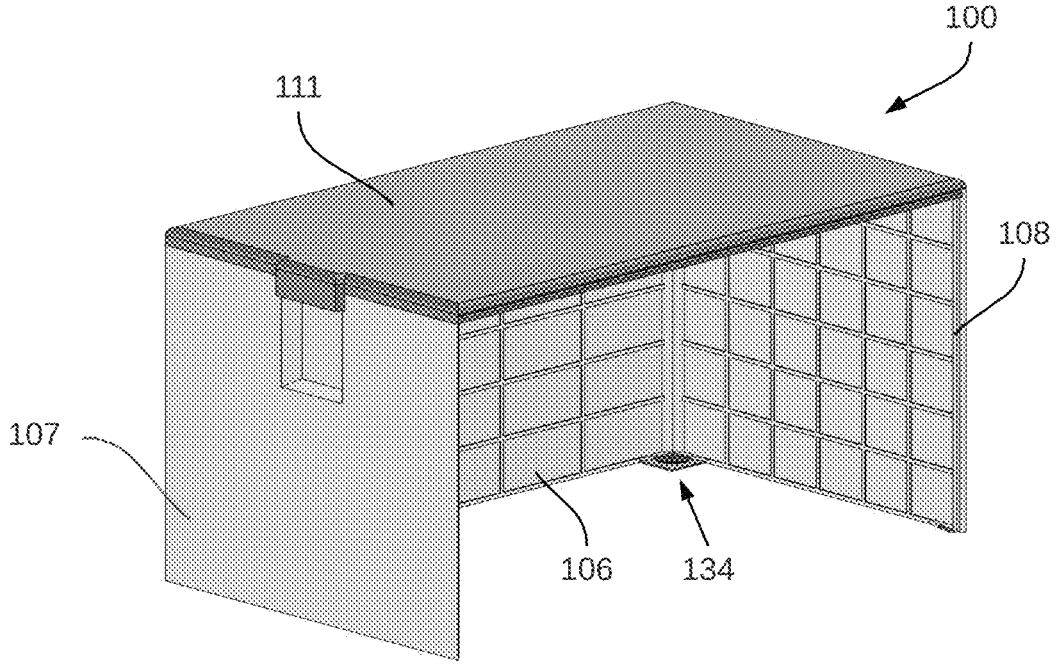
FIG. 8 illustrates a perspective view of an apparatus for housing a delivered parcel, with side/panel shown removed, in accordance with an embodiment.

FIG. 8 illustrates a perspective view of the apparatus 100 for housing a delivered parcel, with the wall 109 (e.g., a side/panel) shown removed, in accordance with an embodiment. FIG. 8 is provided to show a different perspective of the interior of the apparatus 100. The locking mechanism 134 is also shown in FIG. 8 at a bottom corner of the apparatus 100. It can be appreciated that although a single locking mechanism is shown in the embodiment depicted in FIG. 8, additional such locking mechanisms can be used at the other corners. Thus, in some embodiments, a single locking mechanism such as the locking mechanism 134 can be implemented, and in other mechanisms other similar locking mechanisms may be utilized to secure the other corners of the apparatus 100.

Figure 9:
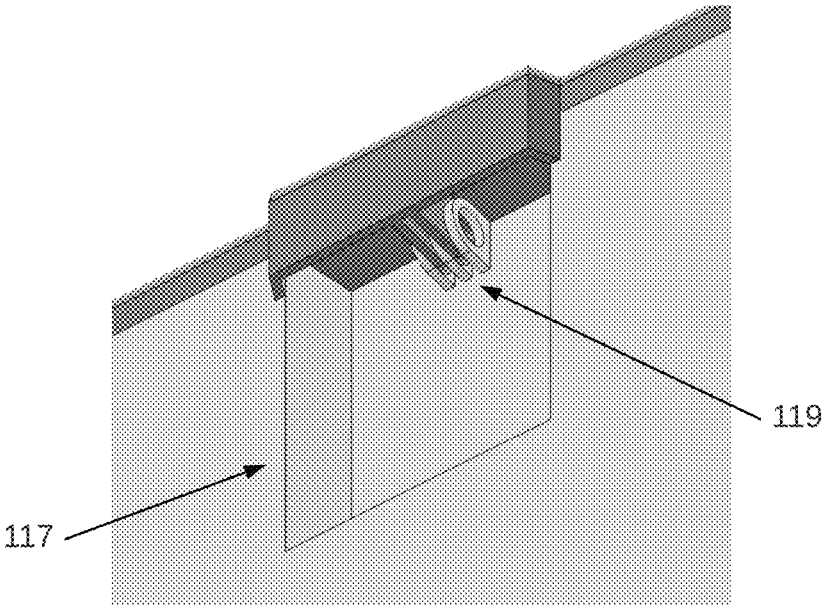
FIG. 9 illustrates a perspective view of a gap with a mounting side lid lock that can be implemented in accordance with an embodiment.

FIG. 9 illustrates a perspective view of a gap 117 with a mounting 119 (e.g., side lid lock mechanism) 119 that can be implemented with the apparatus 100 in accordance with an embodiment. Note that the mounting 119 may be formed from one or more circular rings that can engage with the lid 111. A combination or key padlock may be inserted into the circular rings to secure the lid 111 to the apparatus. Such a combination or key padlock may be positioned within the gap 117 and hang from the circular rings when secured in place to the lid/wall of the apparatus 100 via the mounting 119.

Figure 10:
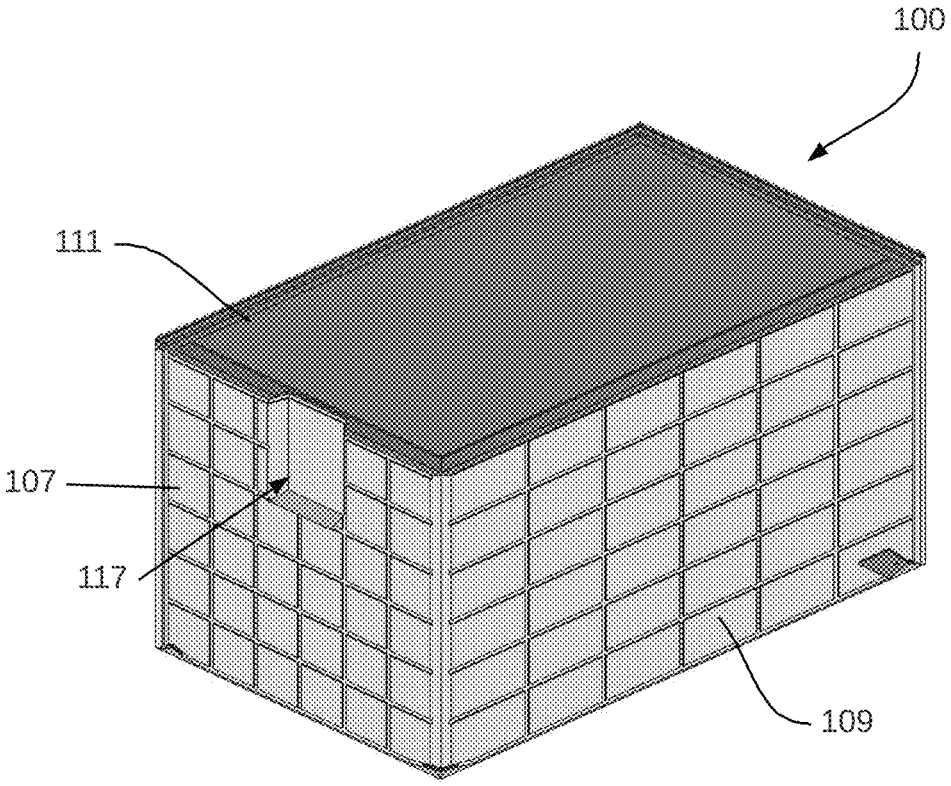
FIG. 10 illustrates a perspective view of an apparatus for housing a delivered parcel, with a mounting side lid lock mechanism and with an inside-out view with two panels removed, in accordance with an embodiment.
Figure 12:
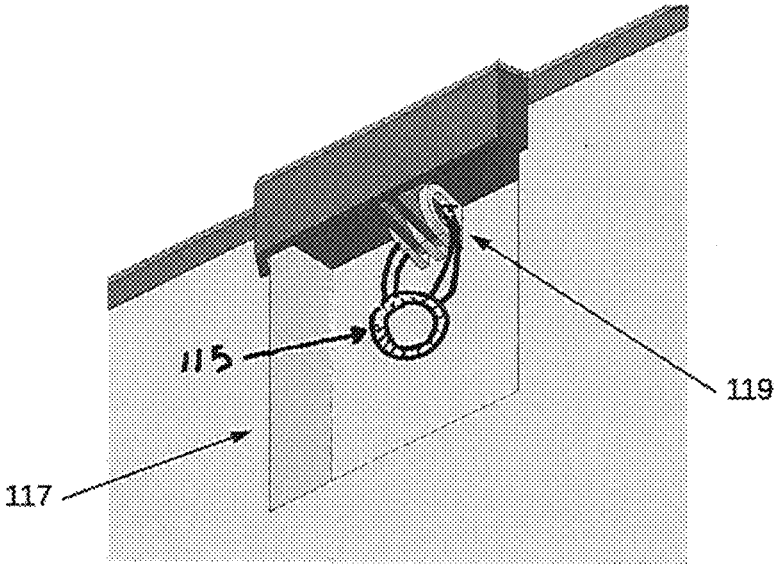
FIG. 12 illustrates a perspective view of the apparatus 100 with a combination lock, in accordance with an embodiment.

FIG. 10 illustrates a perspective view of the apparatus 100 for housing a delivered parcel, with the gap 117 for the mounting 119 of FIG. 9, in accordance with an embodiment. Another view of the arrangement shown in FIG. 9 is also depicted in FIG. 12 illustrating a combination lock 115.

Figure 11:
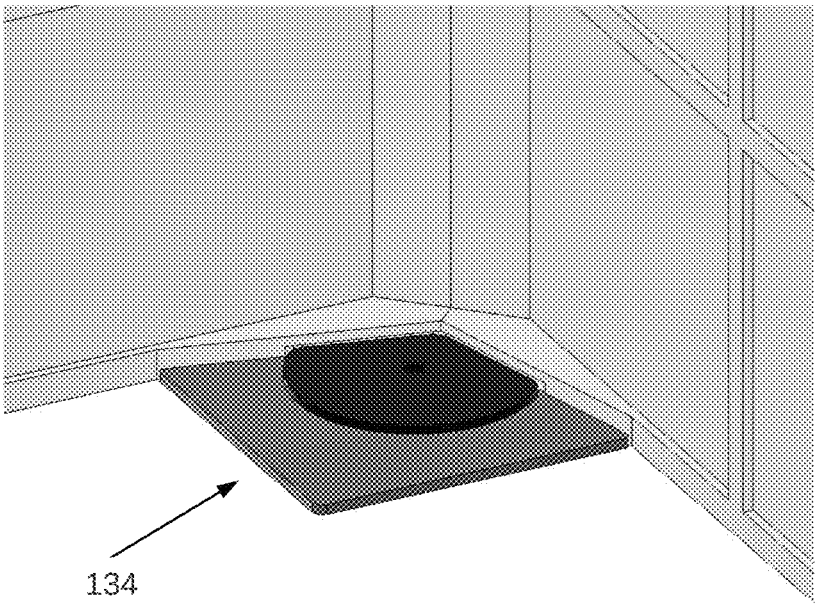
FIG. 11 illustrates a cut-away perspective view of a locking mechanism, in accordance with an embodiment.

FIG. 11 illustrates a cut-away perspective view of the locking mechanism 134, in accordance with an embodiment. Note that in the embodiment of the locking mechanism 134 depicted in FIG. 11 a different configuration can be implemented with protruding plate(s) that angularly extend from the walls of the apparatus 100 and cover and secure at least a part of the circular plate.

The self-contained receptacle disclosed herein can be multi-purposed. In some embodiments, the self-contained receptacle can look and function as a faux flower planter box, for example, when not expecting a delivery. That is, the self-contained receptacle can be configured in various shapes and manners that can disguise it, i.e., in this example as a faux flow planter box. When not in use the self-contained receptacle can be inverted and used as a tote for storage or in a manner the owner sees fit.

In some embodiments, the self-contained receptacle can be configured with four panels and a lid. Two long sides and two short sides can create the general shape of the apparatus 100 (i.e., the self-contained receptacle/box). The four panels can include groove channels that can correspond and slide into place to create the receptacle. These panels can be connected at the joints of the apparatus 100. The lid can function as a structural support for the receptacle by sliding into the self-contained receptacle (i.e., the apparatus 100) rather than on top. The lid can function as the top when a delivery is expected and the box is engaged, and as the bottom when self-contained receptacle is used as a general tote. The self-contained receptacle is also collapsible and disassembles for easier storage.

The corners of the self-contained receptacle can be designed in a manner that can provide more surface area for the key to secure the self-contained receptacle to a locking mechanism. This surface area can be extended for use as, for example, finger grips for tote when the self-contained receptacle is not in use. The lid may be removable from the four walls and can slide in to create the "lid". The lid can include a locking mount that can secure the lid to the self-contained receptacle when a combination lock is in place.

It will be appreciated that variations of the above-disclosed and other features and functions, or alternatives thereof, may be desirably combined into many other different systems or applications. It will also be appreciated that various presently unforeseen or unanticipated alternatives, modifications, variations or improvements therein may be subsequently made by those skilled in the art which are also intended to be encompassed by the following claims.

What is claimed is:

1. A parcel receiving apparatus for housing a delivered parcel, comprising:

a self-contained receptacle comprising a plurality of side walls, an open bottom, and an open top such that the self-contained receptacle defines an interior for housing the delivered parcel therein; a lower interior edge of each of the plurality of side walls including a channel, wherein the self-contained receptacle is collapsible, removable, and securable to a floor;

a lid attached to the self-contained receptacle, wherein the lid is slideable with respect to the open top of the self-contained receptacle to allow access to the interior of the self-contained receptacle for a delivery of the parcel by a courier;

a combination lock and a mounting secures the lid to the open top of the self-contained receptacle, wherein a combination code is provided to the courier in advance of the delivery of the parcel to allow the courier to unlock and slide the lid into an open position and place the parcel within the interior of the self-contained receptacle and slide and lock the lid into a closed position to secure the parcel within the interior of the self-contained receptacle;

a locking mechanism comprising at least one base positioned within the interior of the self-contained receptacle adjacent a corner of the open bottom thereof, the at least one base comprising a plurality of plates the plurality of plates including a bottom adhesive plate having a bottom surface for adhesive securement to the floor, and a second plate forming a key which is positioned on a top surface of the bottom adhesive plate; and wherein the key is movable between a locking position and an unlocking position, wherein in the locking position the key is inserted within the channels of two adjacent side walls of the plurality of side walls to secure the self-contained receptacle to the floor, and in the unlocking position the key is removed from the channels of the two adjacent side walls such that the self-contained receptacle is removable from the floor.

2. The parcel receiving apparatus of claim 1 wherein the second plate is a circular plate.

3. The parcel receiving apparatus of claim 2 wherein the circular plate is rotatable about a center thereof.

4. The parcel receiving apparatus of claim 1 wherein the bottom adhesive plate is triangular in shape.

* * * * *